US011999390B2

(12) United States Patent
Lindenfelser et al.

(10) Patent No.: US 11,999,390 B2
(45) Date of Patent: Jun. 4, 2024

(54) RAIL SYSTEM WITH A RAIL AND MOBILE PARTS MOVABLE ALONG THE RAIL

(71) Applicant: SEW-EURODRIVE GMBH & CO. KG, Bruchsal (DE)

(72) Inventors: Michael Lindenfelser, Bruchsal (DE); Andreas Wanjek, Waghäusel (DE); Zhidong Hua, Bruchsal (DE); Thomas Schäfer, Karlsdorf-Neuthard (DE)

(73) Assignee: SEW-EURODRIVE GMBH & CO. KG, Bruchsal (DE)

( * ) Notice: Subject to any disclaimer, the term of this patent is extended or adjusted under 35 U.S.C. 154(b) by 340 days.

(21) Appl. No.: 17/614,526

(22) PCT Filed: May 26, 2020

(86) PCT No.: PCT/EP2020/025246

§ 371 (c)(1),
(2) Date: Nov. 28, 2021

(87) PCT Pub. No.: WO2020/239264

PCT Pub. Date: Dec. 3, 2020

(65) Prior Publication Data

US 2022/0219743 A1 Jul. 14, 2022

(30) Foreign Application Priority Data

May 29, 2019 (DE) ..... 102019003762.6

(51) Int. Cl.

| | |
|---|---|
| ***B61L 27/70*** | (2022.01) |
| ***B61L 3/22*** | (2006.01) |
| ***B61L 15/00*** | (2006.01) |

(52) U.S. Cl.

CPC ..... *B61L 15/0027* (2013.01); *B61L 3/225* (2013.01); *B61L 3/227* (2013.01); *B61L 27/70* (2022.01); *B61L 2003/228* (2013.01)

(58) Field of Classification Search

CPC .. B61L 15/00; B61L 3/22; B61L 27/00; B61L 15/0027; B61L 27/70; B61L 3/227;
(Continued)

(56) References Cited

U.S. PATENT DOCUMENTS

| | | | |
|---|---|---|---|
| 4,925,424 | A | 5/1990 | Takahashi |
| 6,339,397 | B1 | 1/2002 | Baker |

(Continued)

FOREIGN PATENT DOCUMENTS

| | | | |
|---|---|---|---|
| CH | 676903 | A5 | 3/1991 |
| CN | 101353046 | A | 1/2009 |

(Continued)

OTHER PUBLICATIONS

Translation of DE 3117655 A1 accessed at www.espacenet.com on Dec. 16, 2023. (Year: 1982).*

(Continued)

*Primary Examiner* — James A Shriver, II
*Assistant Examiner* — Hilary L Johns
(74) *Attorney, Agent, or Firm* — CARTER, DELUCA & FARRELL LLP

(57) ABSTRACT

In a rail system with a rail and mobile parts movable along the rail, e.g., rail vehicles, a profiled part is arranged on the rail and includes a cavity, which, e.g., terminates at an opening into the environment. Regions of a mobile part, e.g., regions of each mobile part, at least partially project into the cavity, and at least one transmitter and receiver are situated in the respective region.

25 Claims, 6 Drawing Sheets

(58) Field of Classification Search
CPC ..... B61L 2003/228; B62M 6/75; H01Q 1/32; H01P 3/123
USPC ..... 180/168
See application file for complete search history.

(56) References Cited

U.S. PATENT DOCUMENTS

| | | | |
|---|---|---|---|
| 7,228,747 | B2 | 6/2007 | Pieper |
| 9,048,948 | B2 | 6/2015 | Paral |
| 9,987,948 | B2 | 6/2018 | Maier |

FOREIGN PATENT DOCUMENTS

| | | | | |
|---|---|---|---|---|
| CN | 201553167 | U | 8/2010 | |
| CN | 202949429 | U | 5/2013 | |
| CN | 105358361 | A | 2/2016 | |
| CN | 206954247 | U | 2/2018 | |
| CN | 108725514 | A | 11/2018 | |
| DE | 3117655 | A1 * | 11/1982 | ..... B61L 23/14 |
| DE | 3117655 | A1 | 11/1982 | |
| DE | 8712028 | U1 | 12/1987 | |
| DE | 102010050757 | A1 | 5/2012 | |
| DE | 102012006412 | A1 | 10/2012 | |
| DE | 102012006413 | A1 | 10/2012 | |
| DE | 102013203134 | A1 | 8/2014 | |
| DE | 202016102435 | U1 | 8/2017 | |
| DE | 202016104836 | U1 | 12/2017 | |
| DE | 202016104836 | U1 * | 1/2018 | ..... H04B 10/80 |
| EP | 1604236 | B1 | 5/2013 | |
| EP | 2954592 | A1 | 12/2015 | |
| GB | 8718519 | A | 3/1989 | |
| WO | 03037695 | A1 | 5/2003 | |
| WO | 2012010409 | A2 | 1/2012 | |
| WO | 2014121905 | A1 | 8/2014 | |

OTHER PUBLICATIONS

Translation of DE 202016104836 U1 accessed at www.epsacenet.com on Dec. 16, 2023. (Year: 2018).*

International Search Report issued in corresponding International Application No. PCT/EP2020/025246 dated Aug. 14, 2020, pp. 1-2, English Translation.

Vahle, "SMG—Slotted Microwave Guide Table of Contents" Vahle Communication Systems (May 2006) pp. 1-36.

International Preliminary Report on Patentability issued in corresponding International Application No. PCT/EP2020/025246 dated Nov. 16, 2021, pp. 1-9.

* cited by examiner

RAIL SYSTEM WITH A RAIL AND MOBILE PARTS MOVABLE ALONG THE RAIL

FIELD OF THE INVENTION

The present invention relates to a rail system having a rail and mobile parts that are movable along the rail.

BACKGROUND INFORMATION

Certain conventional rail systems include a rail and mobile parts, which are movable along the rail.

German Patent Document No. 87 12 028 describes a toy rail vehicle.

PCT Patent Document No. WO 2014/121905 describes a system for a signal transmission.

German Patent Document No. 10 2013 203 134 describes a communications device for an exchange of data.

German Patent Document No. 20 2016 104 836 describes a conductor line.

German Patent Document No. 10 2012 006 413 describes a transport system.

European Patent Document No. 1 604 236 describes a variable optical damping element having a hollow core waveguide.

SUMMARY

Example embodiments of the present invention provide a rail system in which the data transmission is to be carried out more easily and in a more economical manner.

According to an example embodiment of the present invention, a rail system includes a rail and mobile parts, e.g., rail vehicles, that are movable along the rail. Arranged on the rail is a profiled part having a cavity, which particularly terminates at an opening into the environment. Regions of a mobile part, e.g., of each mobile part, at least partially project into the cavity, and at least one transmitter and receiver are situated in the respective region.

This has the advantage that data are transmittable between movable mobile parts by transmitting and receiving modulated light. In addition, the data are also transmittable between the moved mobile part and stationary transmitters and receivers. The use of a profiled part provided with an opening slot that extends in the rail direction allows for a data transmission that is free of or at least low in interference. This is because light coming from the environment is able to be shielded virtually completely. In addition, the range of the data transmission is extended because the light intensity diminishes more slowly with increasing distance inside the cavity than in a free space. The more tightly the slot is implemented, the lower the losses and the greater the range. As regions that project into the cavity, the mobile part includes leg regions which hold a transmitter and a receiver into the cavity.

The profiled part thus is arranged as a slotted hollow conductor. An additional advantage is that the light is rerouted in the intended direction at the curves.

According to example embodiments, an absorber is situated between the regions of the mobile part in the rail direction in each case, the absorber being produced from a brush, nonwoven material or plastic, for example. This has the advantage that the regions for the data transmission are separated from one another. Interfering mutual effects are therefore avoidable. As a result, a first region for the data transmission is obtained upstream from the mobile part and a second region is obtained downstream from the mobile part.

According to example embodiments, in a circumferential angle range that encompasses more than 180° in relation to the rail direction, the absorber touches the profiled part or at least has a smaller distance from the profiled part than the regions of the mobile part or the mobile part. This offers the advantage that the absorber may be provided so as to be nearly in contact with the profiled part or may even slide along the profiled part.

According to example embodiments, the transmitter and receiver disposed in a respective region of the mobile part, e.g., a leg region, are situated on the side of the region facing away from the absorber in each case. This offers the advantage that the absorber separates a first spatial region of the data transmission situated at the front in the rail direction from a second spatial region of the data transmission situated at the rear in the rail direction.

According to example embodiments, the particular data transmission channel that is situated in the cavity upstream from the respective absorber in the rail direction is separated from the particular data transmission channel that is situated in the cavity downstream from the absorber in the rail direction. This has the advantage that a low-interference data transmission is obtainable.

According to an example embodiment of the present invention, a rail system includes a rail and mobile parts, e.g., rail vehicles, which are movable along the rail. A profiled part is situated on the rail, which has a cavity that terminates at an opening into the environment, and the profiled part is arranged as a slotted waveguide, e.g., as a hollow waveguide, for example, in order to conduct electromagnetic waves inside the cavity. A mobile part, e.g., each mobile part, has an antenna, which projects at least partially into the cavity, e.g., in order to couple or decouple electromagnetic waves. At least one transmitter and one receiver are situated in a respective region of a mobile part, e.g., each mobile part, outside the cavity, e.g., in such close proximity to the opening that light is able to be radiated into the cavity with the aid of the transmitter, and light conducted through the cavity is able to be detected with the aid of the receiver, e.g., such that the mobile part exchanges data both with the aid of the electromagnetic waves and with the aid of the light. The profiled part is, e.g., made from metal and/or produced as one piece with the rail part, e.g., is integrally configured, and the frequency of the electromagnetic waves range from 1 MHz to 100 GHz, for example.

This offers the advantage that data are transmittable not only with the aid of the slotted hollow conductor, but in the same spatial region also with the aid of the light. Either a higher data transmission rate or greater security is therefore achievable because the data are transmittable using two different physical principles.

According to example embodiments, the mobile part is movable and guided on the rail by wheels and/or rollers. This offers the advantage that the mobile part is arranged as a rail vehicle.

According to example embodiments, an LED or a laser diode for visible or infrared light is used as the transmitter, and/or a photodiode or a phototransistor is used for the detection of visible or infrared light. This offers the advantage that light may be used.

According to example embodiments, a transmitter and a receiver are accommodated in a recess of the profiled part, e.g., the recess is a round hole or a bore whose round hole axis of symmetry or bore axis has an angle of between 10° and 60° with respect to the rail direction, and/or the recess is arranged to pass through the profiled part and/or through the wall of the profiled part. This has the advantage that the mobile part is able to be moved past the stationary transmitter without a collision, that is to say, the transmitter does not narrow the cavity. Data can therefore be transmitted also from the stationary part to the mobile part, and vice versa.

According to example embodiments, the profiled part is arranged in integrated form with the rail, especially as one part. This offers the advantage that the profiled part is provided in integrated form with the rail, which means that no precise relative alignment is required prior to the connection since the production as a continuous casting already results in the integrated rail part.

According to example embodiments, the profiled part has two cavities which extend in parallel with each other and, for example, at a distance from each other. This has the advantage that it allows not only for the use of a monochrome half duplex method during the data transmission but also for a monochrome full duplex method.

According to example embodiments, the profiled part has only a single long cavity. This offers the advantage that the use of two different colors makes it possible to carry out a full duplex method even if only a single, unseparated communications medium is available.

According to example embodiments, the cross-section of the cavity or of the respective cavity is invariant along the rail direction, e.g., unable to be modified. This has the advantage that the profiled part can be produced as a drawn part or as a continuous casting part. The cross-section in the original profiled part thus is constant. Round holes or bores may subsequently be introduced into the profiled part by a post-processing step in order to accommodate the stationary transmitter and receiver. If the profiled part is arranged as a plastic part, a coating may also be applied.

According to example embodiments, the opening of the cavity or the respective cavity is arranged as a slot that extends in the rail direction. This offers the advantage that during its movement, the mobile part is able to project through the slot and into the cavity by the regions, e.g., the leg regions, and is movable in parallel with the slot in the process. The slot direction should be aligned in parallel with the rail direction.

According to example embodiments, the profiled part is produced from plastic, e.g., as a drawn part, or the profiled part is produced from metal, e.g., as an aluminum casting part. This has the advantage that a simple and economical production may be obtained and the profiled part has the same translation symmetry as the rail, which itself is produced as a continuous casting part or drawn part, for example.

According to example embodiments, the profiled part has a coated surface region, the coating, for example, being made of chromium or a chromium-containing alloy, the surface region, for example, bounding and/or restricting the cavity. This offers the advantage that the coating has a reflective effect for light. The range of the light in the cavity is increased as a result.

Further features and aspects of example embodiments of the present invention are described in greater detail below with reference to the appended schematic Figures.

DETAILED DESCRIPTION

Figure 1:
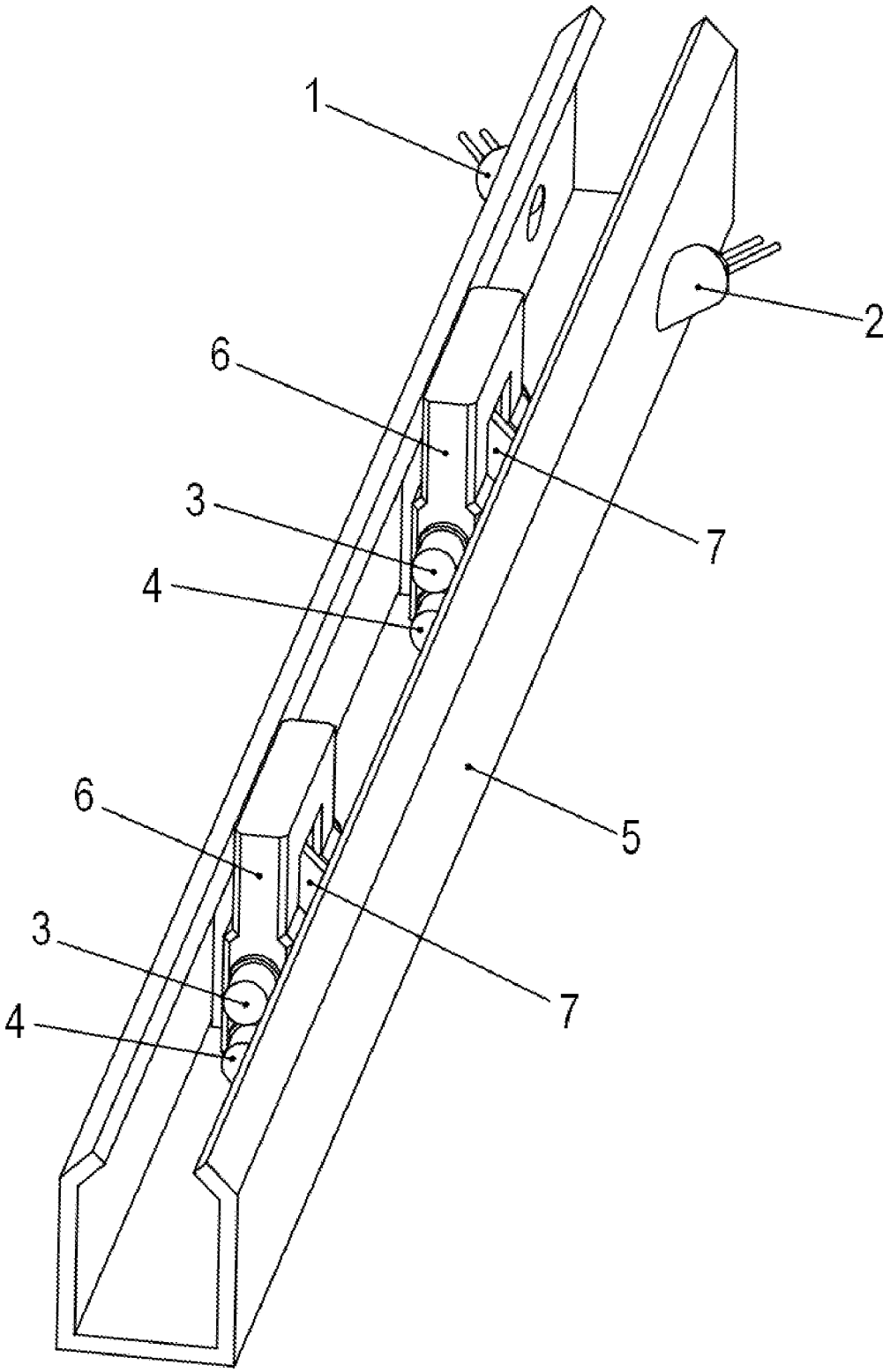
FIG. 1 is a perspective view of a system according to according to an example embodiment of the present invention, the system having a profiled part 5 and mobile parts 6, which are movable along profiled part 5.
Figure 2:
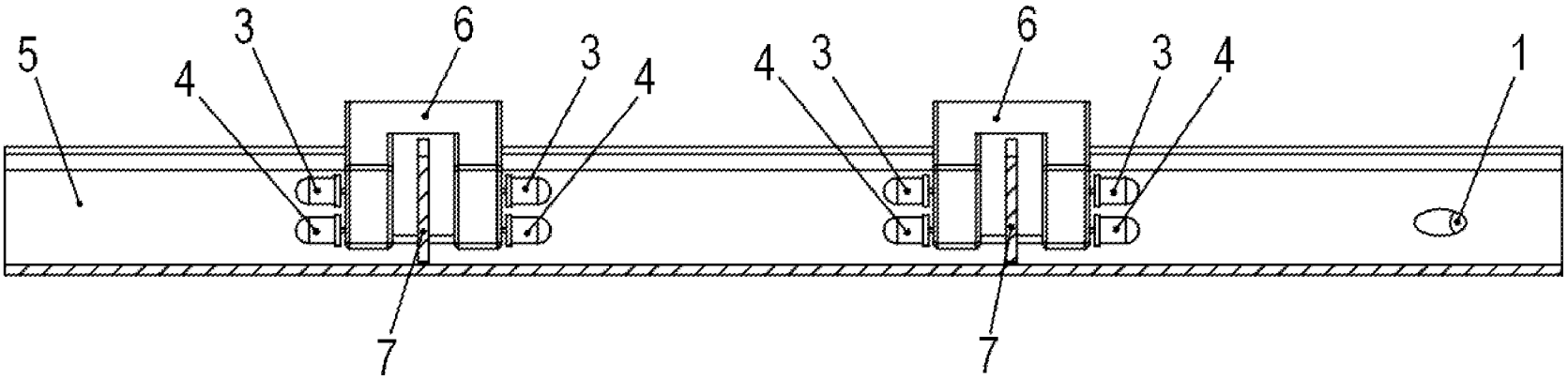
FIG. 2 is an associated longitudinal cross-sectional view.
Figure 3:
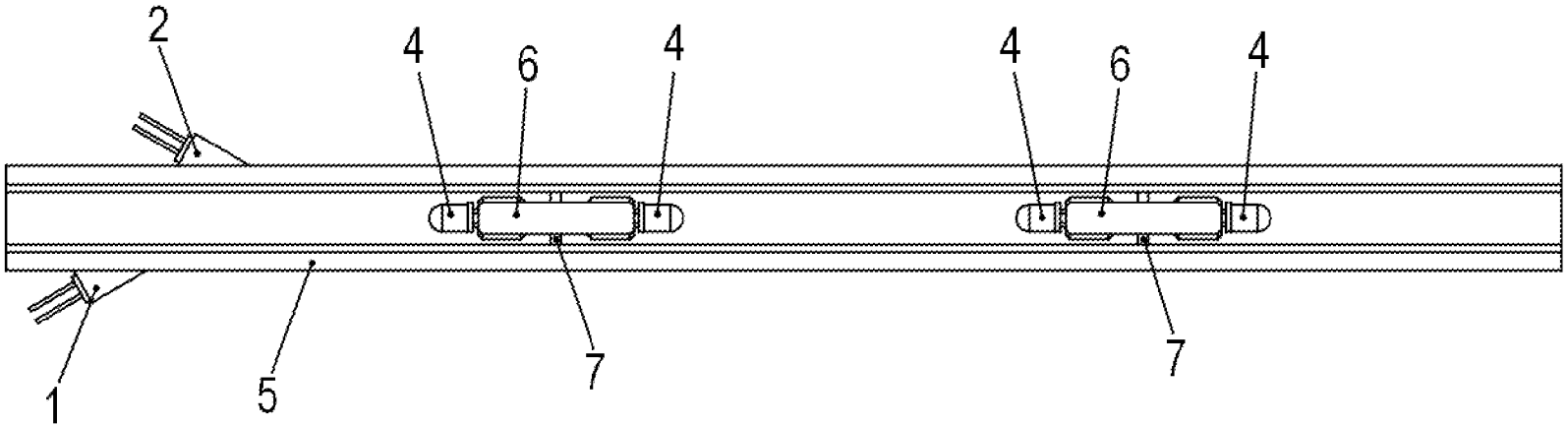
FIG. 3 is an associated top view.

As schematically illustrated in FIGS. 1 to 3, profiled part 5 has a cavity that is arranged to be open toward a first side.

Profiled part 5 is situated in parallel with a system arranged as a rail system.

Mobile parts 6, e.g., rail vehicles, which are movable on the rail are included in the system.

The rail is, for example, produced as a metal profiled part.

Profiled part 5 is, for example, made of plastic, and the cavity of profiled part 5 has mirrored side surfaces. The mirror coating is, for example, produced by a vapor metal deposition using chromium or a chromium-containing alloy, for example.

Mobile parts 6 at least partially project into the cavity of profiled part 5 so that each mobile part 6 has a transmitter 4 and a receiver 3 on the front side in the rail direction. Each mobile part 6 similarly has a transmitter 4 and a receiver 3 also on the rear side.

In the rail direction between transmitter 4 and receiver 3 on the front side and rear side, mobile part 6 has an absorber, which absorbs the radiation, e.g., light radiation, emitted by transmitters 4. The cavity upstream from absorber 7 in the rail direction and the cavity counter to the rail direction downstream from absorber 7 are thereby separated for the radiation to the effect that two separate data communication regions are able to be provided.

This provides for mobile part 6 to exchange data with a further mobile part 6 at a distance in the rail direction, and also with a third mobile part 6 situated at a distance counter to the rail direction.

Mobile parts 6 have, for example, an identical configuration.

In addition, at least one transmitter 2 and one receiver 1 are immovably positioned on profiled part 5. It is therefore also possible to transmit data between a mobile part 6 and the stationary transmitter 2 and receiver 1.

The cavity provided in profiled part 5 has a cross-sectional profile that is invariable in the rail direction because profiled part 5 can be produced as a continuous casting part.

Although the cavity is open to the environment, the inner diameter of the cavity narrows more and more with decreasing distance from the outlet of the cavity to the environment. Thus, the cavity has a slot as an outlet and/or opening.

An LED for the visible or infrared light range may, for example, be used as a transmitter 1, 3 and a correspondingly light-sensitive component such as a phototransistor or a photodiode may, for example, be used as a receiver 1, 3.

Respective absorber 7 is situated on respective mobile part 6 such that the distance from profiled part 5 ideally is kept to a minimum and especially vanishes.

To mount transmitter 4 and receiver 3, the particular region of mobile part 6 that projects into the cavity is provided with two leg regions, which are set apart from each other in the rail direction, e.g., in a U-shape.

Thus, a transmitter 4 and a receiver 3 are situated on each of two the leg regions.

Absorber 7 is situated on the mobile part between the two legs in the rail direction. Absorber 7 projects beyond the legs in all transverse directions in relation to the rail direction.

When transmitters 2 and 4 are all operated at the same frequency, i.e., color, it is therefore possible to use only a half-duplex method in the data transmission.

Figure 4:
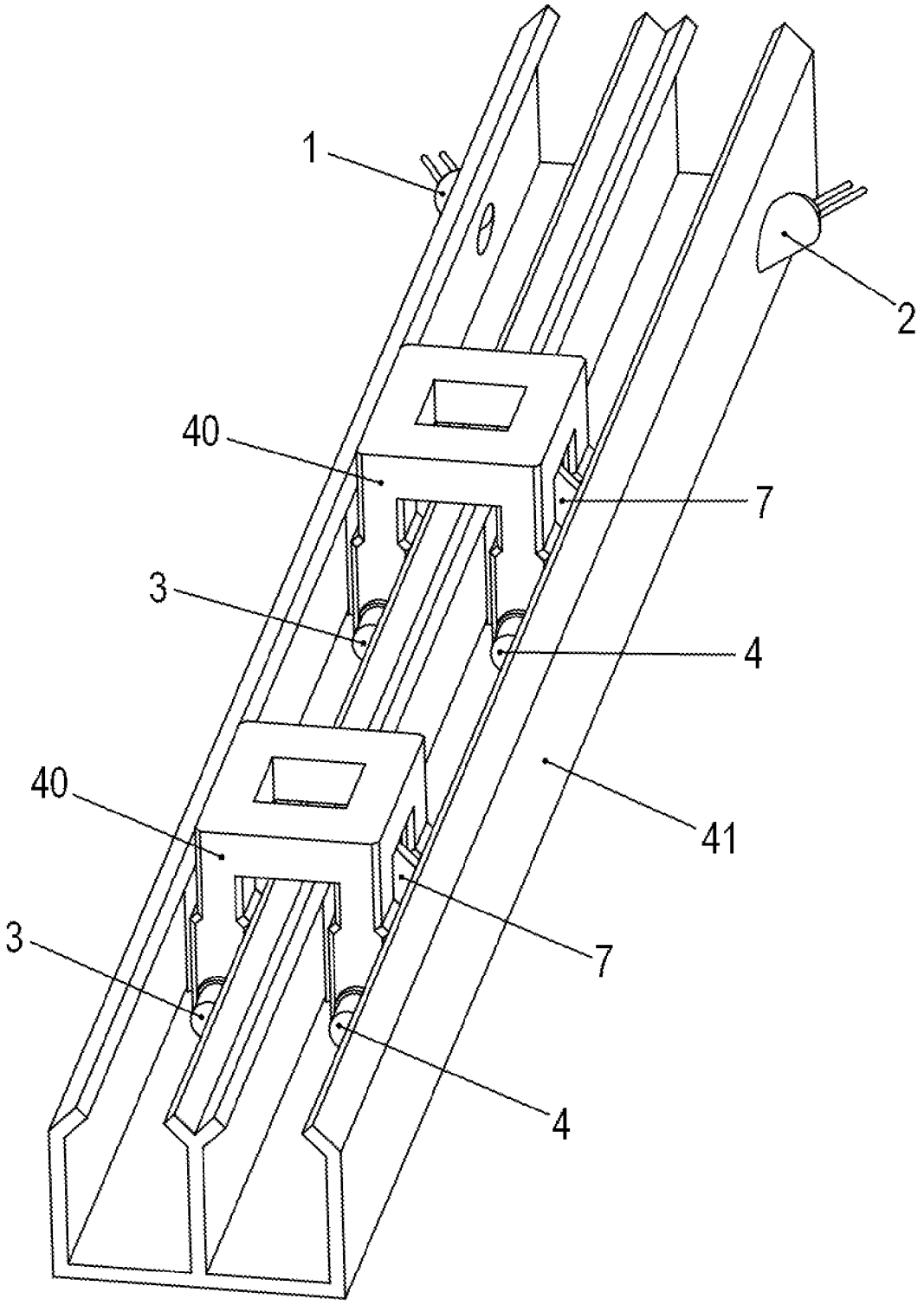
FIG. 4 illustrates a profiled part 41 that has a double cavity.
Figure 5:
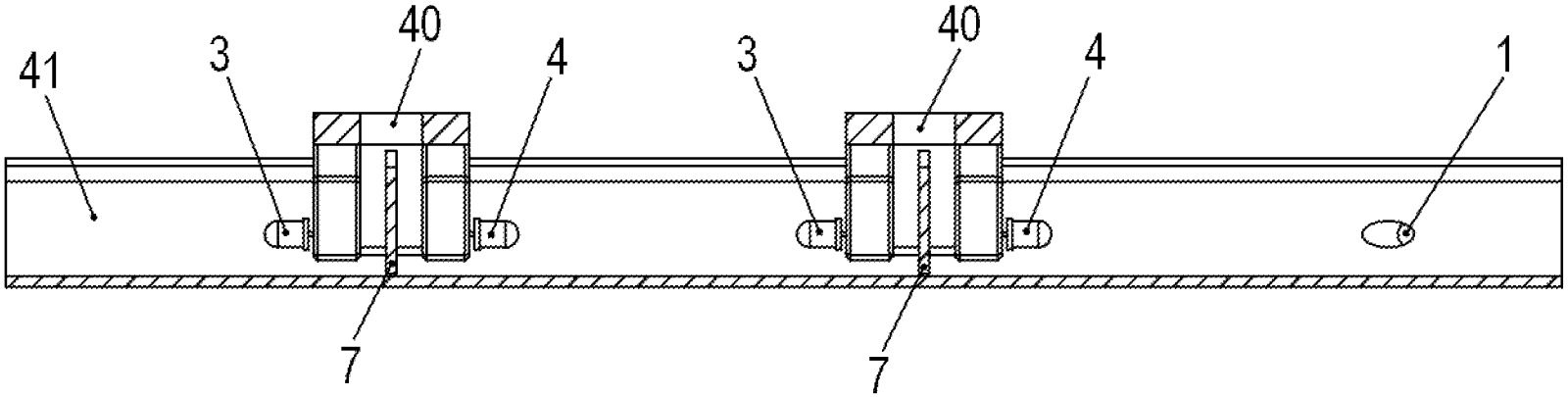
FIG. 5 is an associated longitudinal cross-sectional view.
Figure 6:
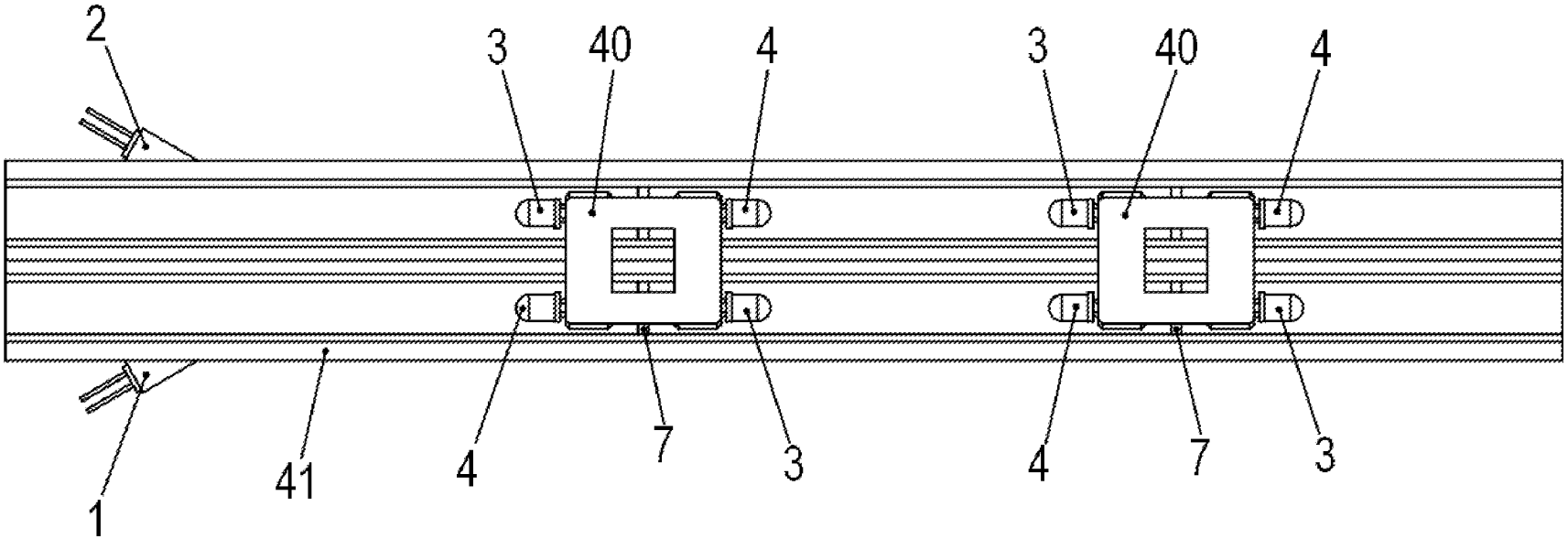
FIG. 6 is an associated top view.

As illustrated in FIGS. 4 through 6, the profiled part is provided with two cavities that extend in parallel with each other. Each of these cavities is similar to the cavity of the exemplary embodiment illustrated in FIGS. 1 to 3.

Mobile part 40 projects into both cavities. For each cavity, mobile part has, for example, two leg regions so that a transmitter 4 and a receiver 3 are situated in each cavity in a respective leg region in the rail direction, and a transmitter 4 and a receiver 3 are situated also in a respective leg region counter to the rail direction.

An absorber 7 is situated in each cavity between the two leg regions in the rail direction, e.g., in accordance with the configuration described for the example embodiment illustrated in FIGS. 1 to 3. Especially for light, the cavity is thus separated with the aid of absorber 7. Light that propagates in front of the mobile part in the rail direction is separated from the spatial region disposed behind the mobile part.

With the aid of the system illustrated in FIGS. 4 to 6, a duplex method is therefore obtainable as a data transmission between two mobile parts because a transmission is able to be carried out in a first one of the cavities, and the receiving for respective mobile part 40 can be obtained in the other. The same applies to the data transmission between the stationary transmitter 2 and receiver 1 and a mobile part 40, i.e., a transmitter 4 and a receiver 3.

In further exemplary embodiments, the respective profiled part 5, 41 is produced from a metal such as aluminum. The surface of the material bordering the respective cavity thus is reflective for the radiation, i.e., especially visible or infrared light. As an alternative, the respective profiled part 5, 41 may be produced from plastic, and thus especially as a profiled plastic part. The surface of the material bordering the respective cavity is, for example, coated with a layer that reflects the radiation, e.g., coated with a chromium layer or a chromium-containing layer.

In further exemplary embodiments, the rail and the profiled part 5, 41 are formed from the same material and thus are integrally configured, i.e., as one part. Thus, the cavity or cavities on the rail is/are provided in integrated form. When the rail system is produced, only the rail thus needs to be installed. The mobile parts 6, 40 are then placed on the rail and project via their leg regions into the cavities so that transmitters 4 and receivers 3 disposed in the leg regions emit radiation into the cavities.

LIST OF REFERENCE NUMERALS

1 receiver
2 transmitter
3 receiver
4 transmitter
5 profiled part
6 mobile part
7 absorber
40 mobile part
41 profiled part

The invention claimed is:

1. A rail system, comprising:

a rail including a profiled part arranged on the rail and having a first cavity and a second cavity that extend in parallel to each other and that terminate at an opening into the environment; and mobile parts adapted to move along the rail;

wherein regions of at least one of the mobile parts at least partially project into the first cavity and into the second cavity, a first one of the regions including a first transmitter and a first receiver arranged in the first cavity, a second one of the regions including a second transmitter and a second receiver arranged in the second cavity, and a stationary transmitter and a stationary receiver are arranged at at least one of the regions of the mobile part that at least partially projects into the first cavity and/or the second cavity.

2. The rail system according to claim 1, wherein the mobile parts include rail vehicles.

3. The rail system according to claim 1, wherein regions of each of the mobile parts at least partially project into the first cavity and into the second cavity.

4. The rail system according to claim 1, wherein an absorber is fastened to the mobile part and an absorber is arranged between the regions of the mobile part in a rail direction.

5. The rail system according to claim 4, wherein the absorber is formed of a brush, a fleece, and/or a plastic material.

6. The rail system according to claim 4, wherein in a circumferential angle range that encompasses more than 180° in relation to the rail direction, the absorber touches the profiled part or has a smaller distance from the profiled part than the regions of the mobile part.

7. The rail system according to claim 4, wherein the stationary transmitter and the stationary receiver are arranged on a side of the region facing away from the absorber.

8. The rail system according to claim 4, wherein a data transmission channel that is arranged in the first cavity and/or the second cavity upstream from the absorber in the rail direction is separated from a data transmission channel that is arranged in the first cavity and/or the second cavity downstream from the absorber in the rail direction.

9. The rail system according to claim 4, wherein a data transmission channel that is arranged in the first cavity and/or the second cavity upstream from the absorber in the rail direction is separated, with the aid of the absorber and with regard to light emitted by the transmitter, from a data transmission channel that is arranged in the first cavity and/or the second cavity downstream from the absorber in the rail direction.

10. A rail system, comprising:

a rail including a profiled part arranged on the rail and having a cavity that terminates at an opening into the environment; and mobile parts adapted to move along the rail and including an antenna projecting at least partially into the cavity to couple and/or decouple electromagnetic waves;

wherein the profiled part is arranged as a slotted waveguide and/or a hollow waveguide and is adapted to conduct electromagnetic waves inside the cavity; and wherein a transmitter and a receiver are arranged in a region of at least one of the mobile parts outside the cavity and in such close proximity to the opening that light is radiatable into the cavity with the aid of the transmitter, and light conducted through the cavity is detectable with the aid of the receiver such that the mobile part exchanges data with the aid of the electromagnetic waves and also with the aid of light.

11. The rail system according to claim 10, wherein the mobile parts are arranged as rail vehicles.

12. The rail system according to claim 10, wherein the profiled part is formed of metal and/or is integral with the rail part.

13. The rail system according to claim 10, wherein a frequency of the electromagnetic waves ranges between 1 MHz and 100 GHz.

14. The rail system according to claim 10, wherein the mobile part is movable and guided on the rail by wheels and/or rollers.

15. The rail system according to claim 10, wherein the transmitter includes an LED and/or a laser diode for visible and/or infrared light.

16. The rail system according to claim 10, wherein the receiver includes a photodiode and/or a phototransistor adapted to detect visible and/or infrared light.

17. The rail system according to claim 15, wherein the receiver includes a photodiode and/or a phototransistor adapted to detect visible and/or infrared light.

18. The rail system according to claim 10, wherein a transmitter and a receiver are arranged in a recess of the profiled part.

19. The rail system according to claim 18, wherein the recess is arranged as a round hole and/or a bore having a round hole axis of symmetry or bore axis having an angle of between 10° and 60° with respect to a rail direction, and/or the recess extends through the profiled part and/or a wall of the profiled part.

20. The rail system according to claim 10, wherein the profiled part is integral to the rail.

21. The rail system according to claim 10, wherein the profiled part includes two cavities that extend in parallel with and at a distance from each other.

22. The rail system according to claim 10, wherein a cross-section of the cavity is invariant and/or unable to be modified along a rail direction.

23. The rail system according to claim 10, wherein the opening of the cavity is arranged as a slot that extends in a rail direction.

24. The rail system according to claim 10, wherein the profiled part is formed of plastic, as a drawn part, from metal, and/or as an aluminum continuous casting part.

25. The rail system according to claim 10, wherein the profiled part includes a coated surface region, a coating of the coated surface region being formed of chromium and/or a chromium-containing alloy, the coated surface region bordering and/or restricting the cavity.

* * * * *